United States Patent [19]

Burke

[11] Patent Number: 4,948,117

[45] Date of Patent: Aug. 14, 1990

[54] SWIM BAND

[76] Inventor: Douglas L. Burke, 133 Syracuse Walk, Long Beach, Calif. 90803

[21] Appl. No.: 312,688

[22] Filed: Feb. 21, 1989

[51] Int. Cl.[5] ..... A63B 21/00

[52] U.S. Cl. ..... 272/71; 272/136

[58] Field of Search ..... 272/71, 136, 139, 900, 272/125, 137, 138; 114/215, 55

[56] References Cited

U.S. PATENT DOCUMENTS 4,544,155 10/1985 Wallenbrock et al. ..... 272/136

4,685,671 8/1987 Hagerman et al. ..... 272/139

FOREIGN PATENT DOCUMENTS 0529810 of 1956 Canada ..... 272/900

*Primary Examiner*—Stephen R. Crow

*Attorney, Agent, or Firm*—Kelly, Bauersfeld & Lowry

[57] ABSTRACT

A swim band is provided for tethering a swimmer in a substantially stationary location within the water while swimming. The swim band utilizes two harnesses which attach the swim band to the swimmer's lower extremities in a releasable and an adjustable fashion. Each harness comprises a flexible belt having a coupling ring attached thereto by a strap. The harnesses are detachably connected to clasps attached at opposite ends of an elonated elastic tubing. The elastic tubing is secured to an anchor strap which is utilized to connect the swim band to a stationary point within or located outside of the water.

19 Claims, 2 Drawing Sheets

SWIM BAND

BACKGROUND OF THE INVENTION

This invention relates generally to an exercising and training aid for swimmers. More particularly, this invention relates to an improved device for maintaining a swimmer substantially in place within the water while allowing the freedom of movement necessary for executing normal swimming strokes.

A common difficulty encountered by swimmers trying to develop endurance, speed and swimming rhythm, is that many swimming areas are inadequate for proper training and exercise. Small home swimming pools of a length less than 25 feet are difficult to practice in because the restricted size of such pools requires the swimmer to turn and change direction too often. Larger public pools are usually crowded, thereby presenting the drawback that the swimmer in training must worry about hitting other swimmers rather than being able to fully concentrate upon the improvement of stroke mechanics, swimming speed, etc. The use of natural bodies of water as training areas is also less than ideal because current flow introduces a drifting effect whereby the swimmer is carried downstream. In short, in order for a swimmer to properly train and exercise while avoiding the above-mentioned drawbacks, a relatively large, dedicated swimming/training area is necessary. Unfortunately, most homeowners lack either the yard space or the financial resources necessary to accommodate such a large pool.

In order to enable a swimmer to get a vigorous workout in a pool which is otherwise inadequate for training exercises, devices have been invented for in-place swimming, whereby the swimmer is restrained to remain relatively stationary within the water while swimming. In-place swimming apparatus for use in existing pools are shown, for example, in U.S. Pat. Nos. 4,544,155; 4,109,905; 4,524,711 and 4,577,859. Many such in-place swimming devices are less than ideal because they either hinder the use of normal swimming strokes, do not adequately provide for the swimmer's comfort, are mechanically complicated, or are not portable.

Generally, prior in-place swimming devices commonly utilize a ring-like harness attached around the swimmer's waist or mid-section to hold the swimmer in place. However, the use of a waist or mid-section harness to restrain the swimmer often disadvantageously affects the swimmer's posture in the water or interferes with the normal breathing movements of the swimmer's diaphragm. Moreover, if the swimmer attempts a strength workout by straining against the harness to add the resistance of the harness to the resistance of the water, thereby presenting a greater force challenging the swimmer's muscles, prior waist or mid-section harnesses will often cut uncomfortably into the swimmer's midriff.

There exists, therefore, a need for an improved device for in-place swimming which maintains the swimmer in a substantially stationary position within the water without hindering the normal breathing and stroking movements of the swimmer. Additionally, an improved in-place swimming device is needed which does not attach around the swimmer's mid-section and that is relatively inexpensive, easy to use and highly portable. Finally, an improved in-place swimming device is needed which comfortably enables a training swimmer to get a heightened workout by straining against the resistance of restraint means as well as against the resistance offered by the water. The present invention fulfills these needs and provides other related advantages.

SUMMARY OF THE INVENTION

In accordance with the invention, an improved swim band is provided which enables a swimmer to remain substantially in-place while swimming, while avoiding the noted drawbacks of prior devices. The swim band generally comprises two harnesses that releasably attach to the swimmer in a manner which will not impede execution of normal swimming strokes, and elongated, elastic tethering means or bands for connecting each harness to anchoring means which are secured to a stationary point located adjacent to the swimming area.

The improved swim band of the present invention advantageously enables a swimmer to exercise in a relatively limited swimming area, such as a small or crowded pool, and further provides means for the swimmer to remain anchored to a spot located externally of a river or other flowing body of water, thereby allowing one to swim in-place without drifting downstream. Yet another advantage of the improved swim band is the training benefit derived when the swimmer pulls against the tension of the elastic tethering means, thereby attempting to overcome a greater resistance than that presented by the water alone. As a result, after training with the swim band, when one swims without being restrained by it, the swimmer's pulling stroke will appear lighter and easier. Further advantages of the swim band are found in utilization of the harnesses which will not chafe the swimmer's skin, interfere with the normal breathing movements of the swimmer's diaphragm, nor interfere with the normal stroke movements of the swimmer's limbs.

Thus, a device for in-place swimming is provided which is ideal for exercise, rehabilitation, training and relaxation. The swim band also provides an excellent aid in the teaching of proper stroke mechanics by enabling a novice swimmer to practice in-place adjacent a swimming instructor.

In accordance with a preferred form of the invention, first and second harnesses are provided for removably and adjustably attaching the swim band to the lower extremities of the swimmer, such as around the swimmer's ankles, feet, calves, thighs, etc. Each harness comprises a flexible belt having hook and loop tape for fastening the belt snugly around the swimmer. The belt of each harness has a flexible fabric strap attached thereto. A ring member is retained on each flexible fabric strap in a manner allowing the ring members to freely slide along their respective strap.

The first and second harnesses are tethered by first and second elongated elastic bands, respectively, to the means for anchoring the swim band to a stationary point. The first elastic band has a first clasp at one end for detachably engaging the ring member of the first harness. The first clasp comprises a hook-like member having a base portion and a spring biased keeper that releasably closes the hook-like member around the ring member. The hook-like member is rotatable relative to its base portion. The second elastic band has a similar second clasp for detachably engaging the ring member of the second harness.

The base portion of the first clasp is configured with a ring-like portion. One end of the first elastic band passes through the ring-like portion of the first clasp and is doubled back upon itself to form a loop within which the ring-like portion is captured. The loop is secured by inner and outer elastomeric skin shrouds which tightly bind around a portion of the doubled back first elastic band. In this manner the first elastic band is connected to the first clasp. In a similar arrangement, an end of the second elastic band is connected to the second clasp.

Both the first and second elastic bands are connected to the anchoring means for the swim band. Preferably, the first and second elastic bands comprise a length of latex tubing having one end connected to the first clasp and the opposite end connected to the second clasp. The mid-point of the tubing is coupled to the anchoring means such that first and second harnesses are each tethered to the anchoring means by substantially equal lengths of tubing. Alternatively, separate pieces of elastic tubing can be utilized as the first and second elastic bands.

The means for anchoring the swim band comprises a flexible fabric strap, preferably Nylon, having coupling means located at opposite ends of the strap. One end of the strap is configured as a loop within which a ring is retained, and the other end of the strap provides a hook-like member similar to that described above in conjunction with the first and second clasps. The anchoring means is wrapped around a stationary point such as a diving board support or pool ladder, and then its hook-like member is releasably closed around the ring retained at one strap end. A buckle encircling the strap of the anchoring means and being freely slidable thereon, is used for attaching the elastic tubing to the anchoring means. In the preferred form of the invention wherein a single elongated piece of tubing is used as the first and second elastic bands, this tubing passes through the buckle and is doubled back upon itself in a manner forming a loop within which the buckle is captured. One or more elastomeric skin shrouds snugly bind the doubled back portion of the tubing.

In use, the anchoring means is first secured to a stationary point conveniently located adjacent to the swimming area. Next, the first and second harnesses are attached to the swimmer, and then both harnesses are tethered to the anchoring means by engaging the first and second clasps with their respective harnesses. At that point, the swimmer is ready to begin in-place swimming.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
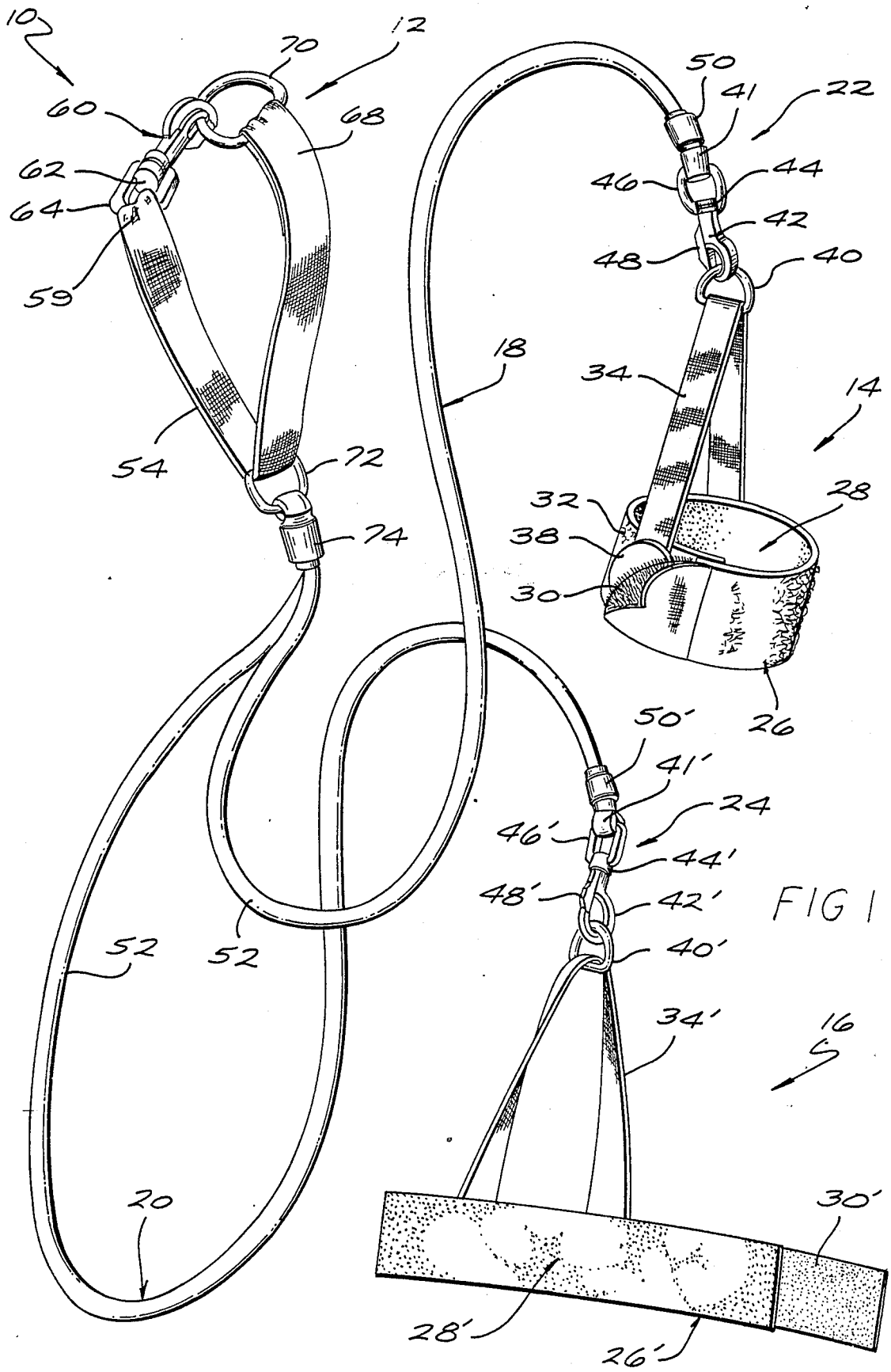
FIG. 1 is a perspective view of a swim band embodying the invention.

As shown in the drawings for purposes of illustration, the present invention relates to an improved swim band 10 for maintaining a swimmer substantially in-place while allowing relatively free movement for the execution of normal swimming strokes. The swim band 10 generally comprises anchoring means 12 (FIG. 1) for securing the swim band to a stationary point located adjacent to a swimming area, and first and second harnesses 14 and 16 which are removably attachable to a swimmer and are tethered to the anchoring means 12 by first and second elongated elastic bands 18 and 20, respectively. Use of the swim band of the present invention to remain substantially stationary within the water during swimming is ideal for exercise, rehabilitation, training, relaxation and the teaching of novice swimmers.

The improved swim band 10 enables a swimmer to train or exercise in a relatively limited swimming area while avoiding the necessity of having to repeatedly turn and change direction. It also beneficially provides means for anchoring a swimmer within a flowing body of water, thereby permitting in-place swimming without becoming subject to current-induced drift. Yet another advantage of the present invention is that it enables one to remain substantially stationary while vigorously working out within a crowded pool, thus greatly alleviating a training swimmer's concerns about colliding with another. Further advantages of the improved swim band 10 of the present invention include its utility as a training aid for improving one's swimming action, whereby a novice swimmer can practice adjacent a swimming instructor while being maintained relatively in-place, rather than moving around the pool and requiring the instructor to follow along. The present invention is also inexpensive, highly portable, and easy to use.

A significant training advantage derived from use of the improved swim band is the strengthening of the swimmer's muscles brought about by continued exertion of the swimmer against the tension of the first and second elastic tethering means, as well as against the normal resistance presented by water. The resultant effect is that upon swimming without the restraint of the swim band, one's pulling stroke, previously trained to overcome the challenging combined resistance of both the water and the stretchable swim band, will be excellently prepared for knifing through water alone. Moreover, the present invention eliminates problems commonly found in prior in-place swimming devices, such as interference with the swimmer's normal stroke or breathing movements, or chafing of the swimmer's skin.

In accordance with a preferred form of the present invention, the first harness 14 is identical to the second harness 16, with FIG. 1 illustrating the former in a fastened configuration and the latter in an open position. Because of their similarity, the following discussion of the first harness 14 applies equally to the second harness 16. In FIG. 1, identical elements of the first and second harnesses 14 and 16 have been designated with the same reference numerals, with the elements of the second harness being differentiated by the inclusion of a prime symbol (') with their corresponding reference numerals. This practice has also been observed in the description included herein of the identical first and second clasps 22 and 24.

The first harness 14 includes a flexible fabric backed foam rubber belt 26 having a Neoprene layer 28 that comprises the inner surface of the belt which contacts the swimmer. The Neoprene layer 28 is smooth and soft, thereby preventing chafing of the swimmer's skin during use of the swim band 10. Hook and loop tape is included for fastening the belt 26. Preferably, hook and loop fastening means are provided by a VELCRO strips 30. The use of VELCRO fastening means beneficially enables one to adjust the tightness of the belt for a comfortable fit.

Figure 3:
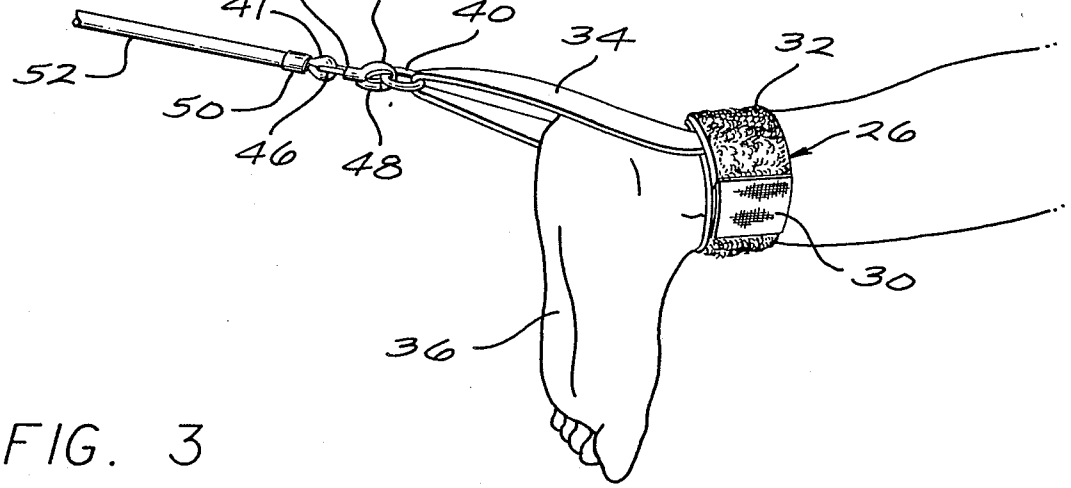
FIG. 3 is a fragmented perspective view illustrating a harness attached around an ankle of the swimmer.

A flexible fabric strap 34 has each of its ends attached to the outer surface 32 of the belt 26 such that the strap 34 forms a loop extending relatively perpendicular to the belt. This provides a directionally biased loop. The strap 34, which is preferably Nylon, is of a length which is sufficient to create a loop large enough to accommodate one of the swimmer's feet 36, as shown in FIG. 3. Preferably, the ends of the strap 34 are stitched to the outer belt surface 32, with circular foam rubber portions 38 being stitched atop each strap end. A hard plastic ring member 40 encircles the flexible strap 34 and is slidably retained thereon.

The ring member 40 serves as a coupling element in the joining of the first harness 14 to the first elastic band 18. The first clasp 22 is connected to one end 41 of the first elastic band 18 for releasably engaging with the ring member 40. The first clasp 22 comprises a non-metallic, non-corrosive hook-like member 42 having a base portion 44 and a ring portion 46. The hook-like member 42 is rotatable relative to the base portion 44, thereby compensating for rolling movements of the swimmer's lower limb to which the first harness is attached. A spring biased keeper 48 releasably closes the hook-like member 42 around the ring member 40, thereby attaching the first harness 14 to the first elastic band 18.

The end 41 of the first elastic band 18 passes through the ring portion 46 of the hook-like member 42 and is doubled back upon itself in a manner forming a loop within which the ring portion is captured. An inner elastomeric skin shroud (not visible) and an outer elastomeric skin shroud 50 are stretched over a doubled back portion of the end 41 to provide a friction fit hold. Preferably, the inner and outer elastomeric skin shrouds are of a latex material.

As noted above, the second harness 16 is similarly connected to the second elastic band 20 using the second clasp 24. The connection of the second clasp 24 to the second elastic band 20 is also done in the same manner described above.

The first and second elastic bands preferably comprise an elongated continuous length of stretchable surgical tubing 52 having the first clasp 22 connected to one end 41, and the second clasp 24 connected to the opposite end 41'. Alternatively, two separate pieces of tubing 52 can be used as the first and second elongated elastic bands. The stretchable tubing 52 comes in various resistances so that the swim band 10 can be designed to provide a selected one of a variety of different tensions for the swimmer to strain against during a strength workout.

Figure 2:
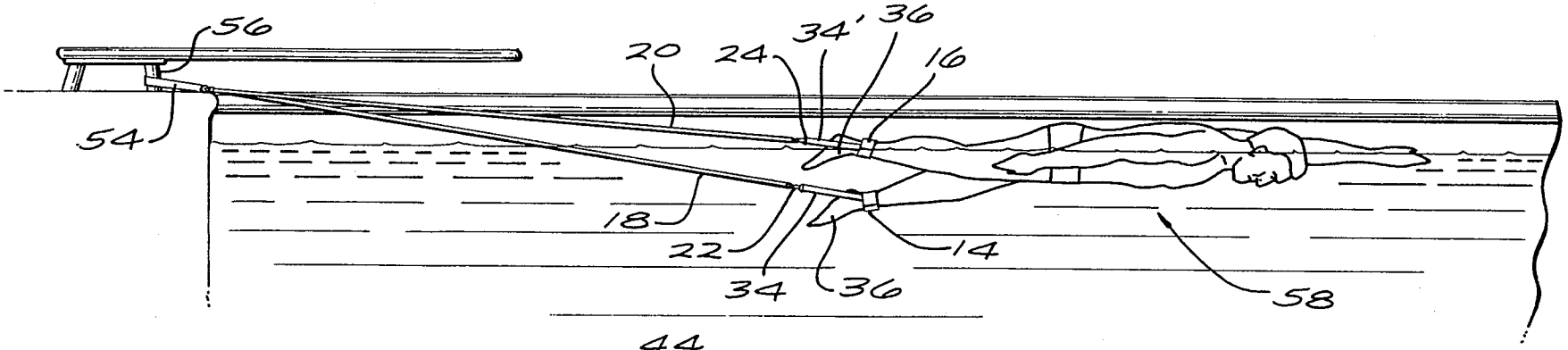
FIG. 2 is a perspective view of a swimmer being maintained in-place while swimming, also illustrating the anchoring means attached around a diving board support.

The first and second elastic bands 18 and 20 tether the first and second harnesses 14 and 16 to the anchoring means 12. The anchoring means 12 comprises a flexible anchor strap 54, which is preferably Nylon, having coupling means attached at each of its opposite ends. Various coupling means can be utilized so long as one is able to fasten the anchor strap 54 to a stationary point, such as a diving board support 56 (FIG. 2).

The coupling means at an end 59 of the anchor strap 54 comprises a hard plastic, hook-like member 60 which is identical in nature to the hook-like member 42 previously described. Specifically, the hook-like member 60 similarly includes a base portion 62, a ring portion 64 and a spring biased keeper 66. The end 59 of the strap 54 passes through the ring portion 64, doubles back upon itself in a manner forming a loop within which the ring portion is captured, and is stitched together in this configuration. The other end 68 is stitched together in an identical loop configuration about a coupling ring 70. Fastening the anchoring means 12 in place is done by wrapping the anchor strap 54 around a fixed point adjacent to the swimming area 58 and engaging the hook-like member 60 with the coupling ring 70.

A buckle 72 encircles the flexible anchor strap 54 and is slidably movable thereon. This buckle 72 should be sized such that it is retained on the flexible strap 54 by the hook-like member 60 at one end and by the coupling ring 70 at the opposite end. The buckle 72 provides a point of attachment for connecting the first and second elastic bands 18 and 20 to the anchoring means 12. This connection is made by passing the stretchable tubing 52 through the buckle 72 and doubling the tubing back upon itself in a manner forming a loop within which the buckle 72 is captured. An inner elastomeric skin shroud (not visible) and an outer elastomeric skin shroud 74 bind the doubled back portion of the tubing adjacent the buckle 72. These shrouds are preferably comprised of a latex material. In an alternative form of the invention, wherein two separate pieces of tubing are utilized as the first and second elastic bands, each piece of tubing is connected individually to the buckle 72 using hook-like members or the like.

In use, the anchoring means 12 is first fastened to a stationary spot located adjacent to the swimming area 58. The harnesses are then fastened around the swimmer's lower extremities. Preferably, the harnesses are attached to the ankles or feet of the swimmer, however the swimmer's calves or thighs could also be used as attachment locations by providing suitably sized belts 26. Finally, the first and second clasps 22 and 24 are used to connect the harnesses 14 and 16 to the tubing which comprises the first and second elastic bands 18 and 20. The swimmer is then ready to begin in-place swimming.

From the foregoing, it will be appreciated that the swim band 10 allows a swimmer to exercise in a relatively stationary area within the water while being restrained in a comfortable manner which does not hinder normal stroking or breathing movements. Further, the swim band is inexpensive, portable and can be adapted-to with very little practice. Moreover, the in-place swimming workouts achievable with use of the present invention advantageously enable one to avoid the drawbacks generally associated with swimming in small or crowded pools, or in a flowing body of water. Finally, the stretchable swim band helps to develop a swimmer's muscles by providing additional resistance for the swimmer to overcome during a strength workout.

While a particular form of the invention has been illustrated and described, it will be apparent that various modifications can be made without departing from the spirit and scope of the invention. Accordingly, it is not intended that the invention be limited, except as by the appended claims.

I claim:

1. An apparatus for in-place swimming whereby a swimmer is tethered to a stationary point located adjacent to a swimming area, the apparatus comprising:

a first harness removably attachable to the swimmer at a first location on one lower extremity of the swimmer, wherein the first harness comprises first belt means adapted to be releasably secured around the swimmer at the first location, the first belt means having a first flexible strap attached thereto and supporting a first ring-like member;

a second harness removably attachable to the swimmer at a second location on the other lower extremity of the swimmer, wherein the second harness comprises second belt means adapted to be releasably secured around the swimmer at the second location, the second belt means having a second flexible strap attached thereto and supporting a second ring-like member;

means for anchoring the apparatus to the stationary point located adjacent to the swimming area;

a first elongated elastic band having attached at an end thereof a first clasp for detachably engaging the first harness, wherein the first clasp comprises a first hook-like member in releasable engagement with the first ring-like member, the first hook-like member being attached to a base portion of a third ring-like member, the third ring-like member provided means for joining the first clasp to the first elastic band;

a second elongated elastic band having attached at an end thereof a second clasp for detachably engaging the second harness, wherein the second clasp comprises a second hook-like member in releasable engagement with the second ring-like member, the second hook-like member being attached to a base portion of a fourth ring-like member, the fourth ring-like member providing means for joining the second clasp to the second elastic band; and means for connecting the first and second elastic bands to the anchoring means.

2. An apparatus as set forth in claim 1, wherein the first and second belt means include fastening means comprising hook and loop tape.

3. An apparatus as set forth in claim 1, wherein the first and second locations are the ankles of the swimmer.

4. An apparatus as set forth in claim 1, wherein the first hook-like member includes a spring biased keeper for closing the first hook-like member around the first ring-like member, and the second hook-like member includes a spring biased keeper for closing the second hook-like member around the second ring-like member, and wherein the first and second hook-like members are each rotatable relative to the base portion attached thereto.

5. An apparatus as set forth in claim 1, wherein the means for anchoring comprises a flexible strap having cooperating coupling means.

6. An apparatus as set forth in claim 5, wherein the first and second elastic bands comprise a continuous length of tubing having one end connected to the first clasp and the opposite end connected to the second clasp.

7. An apparatus as set forth in claim 6, wherein the means for connecting the first and second elastic bands to the anchoring means comprises a buckle through which the flexible strap and the tubing passes.

8. An apparatus as set forth in claim 7, wherein at least one elastomeric skin shroud binds the tubing adjacent the buckle, the tubing being bound in a configuration whereby said tubing is doubled back upon itself to form a loop within which the buckle is captured.

9. An apparatus as set forth in claim 8, wherein the tubing and the at least one elastomeric skin shroud are comprised of a latex material.

10. An apparatus as set forth in claim 1, wherein the first and second flexible straps are attached, respectively, to the first and second harnesses to provide directionally biased loop means for preventing the flexible straps from interfering with articulation of the swimmer's lower extremities.

11. A device for maintaining a swimmer substantially in-place while allowing the swimmer relatively free movement for executing normal swimming strokes, the device comprising:

means for anchoring the device adjacent to a swimming area;

a first harness removably attachable to the swimmer at a first location on one lower extremity of the swimmer, the first harness comprising first belt means which wrap around the swimmer at the first location, the first belt means including means for fastening the first belt means around the swimmer in a releasable and adjustable fashion;

a second harness removably attachable to the swimmer at a second location on the other lower extremity of the swimmer, the second harness comprising second belt means which wrap around the swimmer at the second location, the second belt means including means for fastening the second belt means around the swimmer in a releasable and adjustable fashion;

a first elongated elastic band having located at an end thereof a first clasp for detachably engaging the first harness means; and a second elongated elastic band having located at an end thereof a second clasp for detachably engaging the second harness, wherein the first and second elastic bands are connected to the anchoring means;

wherein the first harness further includes a first flexible strap attached to the first belt means, the first flexible strap being adapted for coupling with the first clasp, the second harness further including a second flexible strap adapted for coupling with the second clasp, wherein the first clasp includes a hook-like member connected to a base portion of a first ring-like member, the first elastic band being doubled back upon itself at one end in a manner forming a loop within which the first ring-like member is captured, wherein a doubled back portion of the first elastic band is snugly surrounded by an inner elastomeric skin shroud and an outer elastomeric skin shroud, and wherein the second clasp includes a hook-like member connected to a base portion of a second ring-like member, the second elastic band being doubled back upon itself at one end in a manner forming a loop within which the second ring-like member is captured, wherein a doubled back portion of the second elastic band is snugly surrounded by an inner elastomeric skin shroud and an outer elastomeric skin shroud.

12. A device as set forth in claim 11, wherein the anchoring means comprises a flexible fabric strap having a ring member attached at one end and a hook-like member attached at the opposite end, wherein the hook-like member is adapted to be releasably closed about the ring member.

13. A device as set forth in claim 11, wherein the first and second locations are the feet of the swimmer.

14. An apparatus as set forth in claim 12, wherein the first and second flexible straps are attached, respectively, to the first and second harnesses to provide directionally biased loop means for preventing the flexible straps from interfering with articulation of the swimmer's lower extremities.

15. A swim band for enabling a swimmer to remain substantially in-place while swimming, the swim band comprising:

a first harness including first belt means having VELCRO portions thereon for releasable and adjustable fastening of the first belt means around the swimmer, the first harness also including a first strap member wherein a first coupling member is slidably retained on the first strap member;

a second harness including second belt means having VELCRO portions thereon for releasable and adjustable fastening of the second belt means around the swimmer, the second harness also including a second strap member wherein a second coupling member is slidably retained on the second strap member;

means for anchoring the swim band adjacent to a swimming area, wherein the anchoring means comprising a flexible anchor strap having a first end which is doubled back upon itself to form a loop within which a ring-like member is captured, and a second end which is doubled back upon itself to form a loop within which a ring portion of a hook-like member is captured, wherein the hook-like member is adapted for releasable engagement with the ring-like member and includes a spring biased keeper closing the hook-like member around the ring-like member, and wherein the ring portion is rotatable relative to a hook portion of the hook-like member; and an elongated, elastomeric tubing having a first clasp located at one end for detachably engaging the first coupling member, and a second clasp located at an opposite end for detachably engaging the second coupling member, wherein the tubing is connected to the anchoring means such that the first and second harnesses are each tethered to the anchoring means by substantially equal length tubing portions.

16. A swim band as set forth in claim 15, wherein the first and second belt means are comprised of fabric having a Neoprene layer thereon.

17. A swim band as set forth in claim 16, Wherein the first and second strap members and the flexible anchor strap are comprised of Nylon and wherein the tubing is comprised of a latex material.

18. A swim band as set forth in claim 16, wherein the first and second coupling members, the first and second clasps, the ring-like member and the hook-like member are all comprised of a nonmetallic, non-corrosive material.

19. A swim band as set forth in claim 16, wherein the first and second flexible strap members are attached, respectively, to the first and second harnesses to provide a directionally biased loop means for preventing the flexible straps from interfering with articulation of the swimmers lower extremities.

* * * * *

UNITED STATES PATENT AND TRADEMARK OFFICE

CERTIFICATE OF CORRECTION

PATENT NO. : 4,948,117

DATED : August 14, 1990

INVENTOR(S) : Douglas L. Burke

It is certified that error appears in the above-identified patent and that said Letters Patent is hereby corrected as shown below:

In the Abstract, line 9, delete the word "elonated" and insert therefor --elongated--.

In Column 9, line 6, delete "12" and insert therefor --11--.

In Column 10, line 29, delete "16" and insert therefor --15--.

Signed and Sealed this

Twenty-fifth Day of February, 1992

*Attest:*

HARRY F. MANBECK, JR.

*Attesting Officer*

*Commissioner of Patents and Trademarks*